United States Patent [19]

House

[11] 4,099,681

[45] Jul. 11, 1978

[54] BLADE-TYPE HOLDER FOR PAPER ROLLS

[76] Inventor: Bennie L. House, P.O. Box 577, Hickory Ridge, Ark. 72347

[21] Appl. No.: 778,348

[22] Filed: Mar. 17, 1977

[51] Int. Cl.[2] ..... B65H 19/00

[52] U.S. Cl. ..... 242/55.2; D 6/97

[58] Field of Search ..... 242/55.2, 55.5, 55.3, 242/55.53; D6/97; 225/46

[56] References Cited

U.S. PATENT DOCUMENTS

| | | | |
|---|---|---|---|
| 1,156,266 | 10/1915 | Bens | 242/55.2 |
| 2,244,804 | 6/1941 | Robinson | 242/55.2 |
| 3,833,180 | 9/1974 | Balasic | 242/55.2 |
| 3,892,368 | 7/1975 | Ricards | 242/55.2 |

*Primary Examiner*—Edward J. McCarthy
*Attorney, Agent, or Firm*—Robert R. Keegan

[57] ABSTRACT

There is disclosed a paper roll holder for rolls of toilet tissue, paper toweling, or the like which is characterized by simplicity of construction, the simplest construction having only two parts, and by ease of disassembly to replace paper rolls; at the same time, the construction of the holder minimizes the possibility of accidental displacement of the spindle and the paper roll which it supports; at each end of the spindle is a blade preferably tetragonal in cross section which engages a slot similar in shape in the arm of the paper roll holder; a cowl integrally formed at the end of the spindle conceals the blade and the slot and covers and further engages the end of the arm of the holder.

10 Claims, 5 Drawing Figures

BLADE-TYPE HOLDER FOR PAPER ROLLS

The relatively simple problem of providing a neat, functional and readily maintainable holder for dispensing paper from a roll has evoked a variety of such fixtures. Most of them currently used involve a spring-loaded detent mechanism to retain the spindle of the holder in place between a pair of arms. These types of devices are likely to suffer damage if the spring-loading mechanism is not properly released when removing the spindle for replacement of the paper roll. Furthermore, the detent mechanism is often unsightly and in any event adds to the complication and thus the cost of producing the holder.

Locking mechanisms for retaining the spindle in place suffer the same disadvantages as spring detent arrangements. Some paper roll holders having neither latches nor spring detents support the ends of the spindle in a cradle which may permit easy removal of the spindle and paper roll. However, the forces and torques imparted to the spindle upon dispensing paper from the roll tend to accidentally dislodge the spindle and paper roll in this construction. There are also spindleless dispensers in which spring-loaded hubs engage the two ends of a paper roll. This construction has the disadvantage that the roll is not particularly easy to remove, but at the same time it may be dislodged when dispensing paper particularly if the cardboard core for the paper roll tears or bends.

The present invention provides a paper roll holder which remarkably combines the advantage of easy removal of the roll for replacement of the paper together with minimum possibility of accidental dislodgement of the spindle. The spindle is supported by arms and held in place by virtue of blade-like projections on the ends of the spindle which mate with slots in the ends of the arms. The spindle is easily removed by a straight upward motion, but any other direction of force or any torque applied to the spindle results in frictional engagement of the blades on the spindle with the slots in the arms, thus producing considerable resistance to displacement of the spindle. Since dispensing the paper virtually invariably results in a torque applied to the spindle together with a force in the direction other than vertically upward, there is only a minimal possibility of the accidental dislodgement of the spindle and paper roll.

Prior art approaches to the problem discussed above are represented in U.S. Pat. Nos. 1,973,354 to Nedberg; 2,244,804 to Robinson; 3,799,467 to Bauman; 3,833,180 to Vlasic; and 3,892,368 to Ricards.

It is an object of the present invention to provide a paper roll holder which permits easy one-handed removal of the spindle and exhausted paper roll for replacement, and at the same time, it is constructed to minimize accidental dislodgement of the paper roll when paper is dispensed.

It is another object of the present invention to provide a paper roll holder which is of simple construction, essentially two or three pieces and which contains a blade-type engaging action between the spindle and the support arms.

It is a still further object of the present invention to provide a paper roll holder of the foregoing type in which the blades and the slots which they engage are concealed in a smooth and neat-appearing arm and spindle construction.

Other objects and advantages in addition to those described above will be apparent from consideration of the following description in conjunction with the appended drawings in which.

Figure 1:
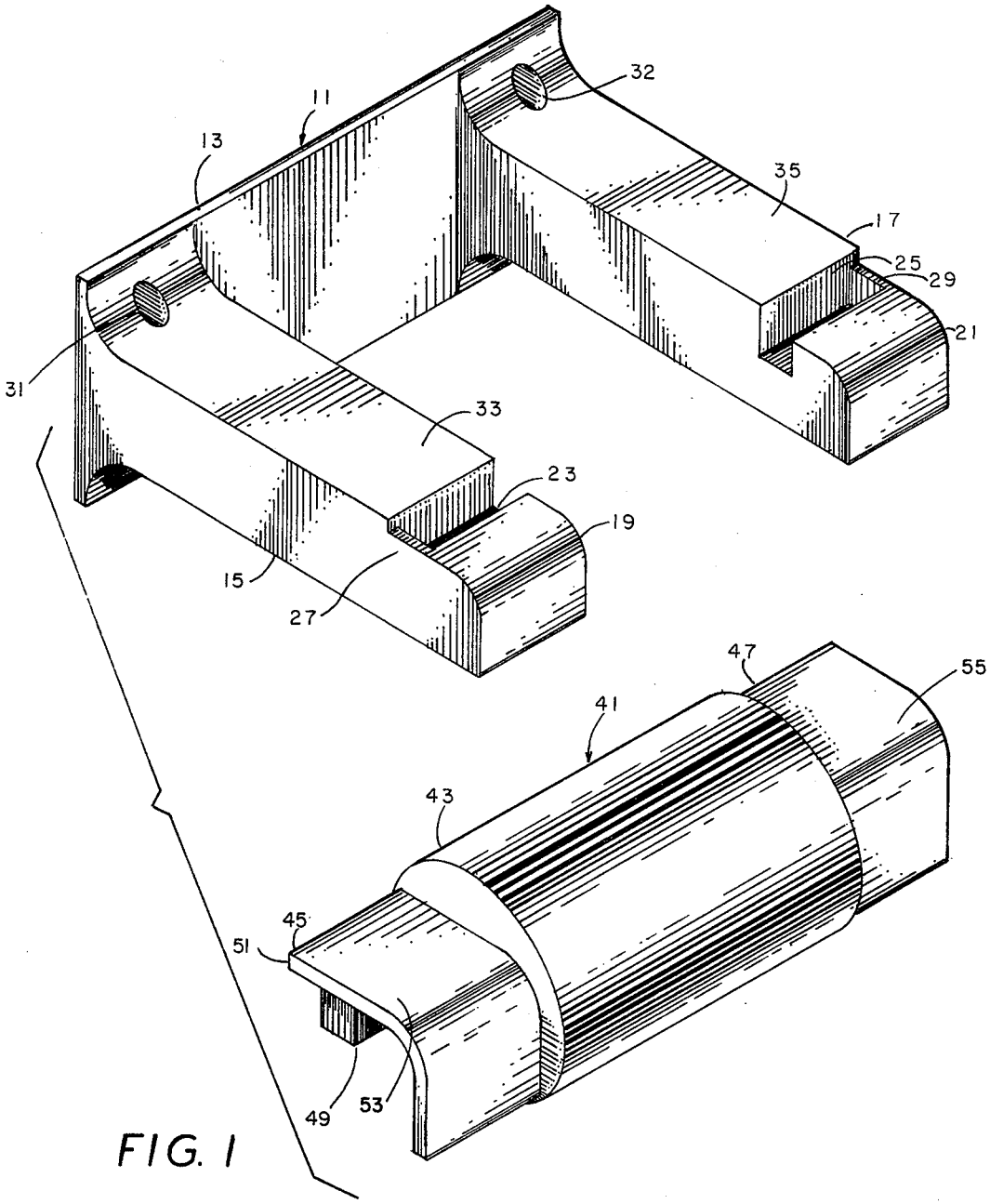
FIG. 1 is an isometric view of one embodiment of a paper roll holder according to the invention.

Referring to FIG. 1, a paper roll holder according to the invention is shown with the spindle removed from the arms as it would be in placing a new roll of paper in the holder. In this embodiment, there are only two parts, the wall-mounted part 11 and the spindle 41. The wall-mounted part 11 includes a bracket portion 13 having two arms 15 and 17 formed integrally therewith.

The arms 15 and 17 are spaced apart to accommodate a particular type of paper roll, in the case of FIG. 1 a toilet tissue roll. Each of the arms 15 and 17 has respective curved end surfaces 19 and 21.

Near the end of each of the arms 15 and 17 are slots 23 and 25 which as will later be seen support and retain the spindle structure 41. Preferably, but not necessarily, the ends of the slots 23 and 25 terminate short of the outer vertical surfaces of the arms 15 and 17 and are hence concealed by slot cover portions 27 and 29. The wall-mounted portion 11 of the holder may be attached to the wall in any desired fashion. In the FIG. 1 embodiment screw holes 31 and 32 are provided for securing the holder in place preferably by countersunk screws. Alternatively, the bracket portion 13 may be adhered to the wall with glue or other adhesive material and a large, flat surface is available on the back of the holder to facilitate this form of wall attachment.

The spindle 41 includes a generally cylindrical support 43 which is at least slightly shorter in length than the spacing between arms 15 and 17. Two blades 49 (the right blade is not visible in FIG. 1 but is symmetrically disposed) are shaped and dimensioned to fit moderately snugly in slots 23 and 25. A pair of hoods or cowls 53 and 55 serve to conceal the blades 49 and give a smooth appearance when the holder 41 is placed between the arms 15 and 17.

When the spindle 41 is in place the surface of hood 45 is level with the top surface 33 of arm 15 and effectively forms a continuation thereon. The same is true of hood 47 and arm 17. The curve of the hoods 45 and 47 preferably follows the curved surfaces 19 and 21 of arms 15 and 17 so that the hood 45 appears in all respects as a continuation of the end of the arm 15 as does the hood 47 with respect to arm 17. Preferably the end surface 51 and the corresponding surface on the other end of the spindle are flush with the outer surfaces of the arms 15 and 17 and particularly with the slot cover portions 27 and 29.

It will be apparent from the foregoing description of FIG. 1 that the spindle 41 is readily removed from the holder with a vertical lifting motion without rotation of the spindle. On the other hand, forces tending to move the spindle in any other manner will cause blades 49 to bind in slots 23 and 25 thus making accidental dislodgement of spindle 41 highly unlikely.

Blades 49 are shown with parallel faces in FIG. 1 as are slots 23 and 25. It will be appreciated, however, that a slight taper to the blades 49 and a corresponding taper to the walls of slots 23 and 25 may be desirable. Such taper may aid in fabrication by molding or casting and may also produce a tight wedge fit of the spindle in the slots 23 and 25.

The hoods 45 and 47 in addition to concealing blades 49 and slots 23 and 25 also tend to restrain the spindle 41 from accidental dislodgement in that the hoods 45 and 47 engage the ends of arms 15 and 17 between slots 23 and 25 and ends of the arms. While it is desired that the slots 23 and 25 and also the blades 49 extend approximately vertically, it may be desirable that the bottom of the slots 23 and 25 extend slightly in the direction of the ends of the arms 15 and 17 and that a similar slant is imparted to blades 49. If the front ends of the arms and of hoods 45 and 47 had a similar slant then the spindle could be removed only by a slightly rearward and upward motion. This would have the effect of still further reducing the likelihood of accidental displacement of the spindle 41.

While the cylindrical shape for the support 43 is shown as the preferred one, there is obviously no necessity that it have such shape. In particular, the quantity of material required for the spindle 41 may be substantially reduced by causing the bottom of the support 43 to be hollowed out. It is contemplated that arms 15 and 17 would be solid, but material may also be conserved by hollowing arms 15 and 17 from the bottom.

The paper roll holder in FIG. 1 has particular advantages for applications where difficulty of removal of the spindle is to be minimized as would be desired in the home.

A simple modification of the structure of FIG. 1, however, makes it suitable for public places where the spindle should not be readily removable. For example, a tapped hole may be provided in the slot cover portion 47 (or elsewhere) for a hex-head or similar set screw which may have a head adaptable to be engaged by a special wrench. The end of blade 49 may be provided with a hole or indentation to accept the end of the set screw. Thereby spindle 41 would be susceptible of being fastened in place by tightening the set screw so that the spindle could be readily removed only by janitorial employees with the proper special wrench.

Other variations to the paper roll holder of FIG. 1 will be apparent. One such variation is illustrated in FIGS. 2 through 5 which also has numerous common features to the holder illustrated in FIG. 1.

Figure 2:
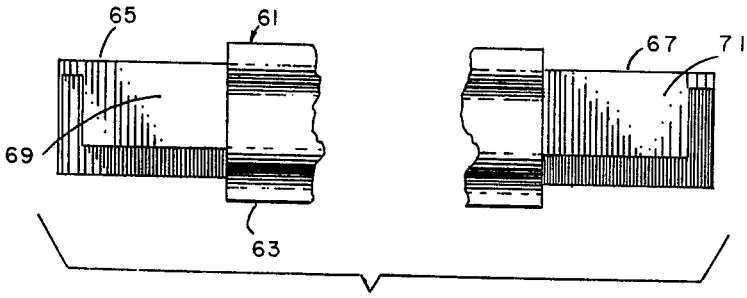
FIG. 2 is a partially fragmentary elevational view of a spindle portion of an alternative embodiment of the invention.
Figure 4:
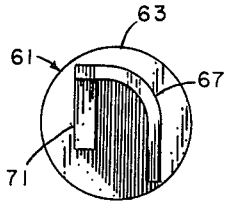
FIG. 4 is an end view of the spindle of FIG. 2.

A spindle 61 for the alternative embodiment of the paper roll holder is shown in FIGS. 2 and 4. The spindle 61 will be made a length suitable for the paper roll with which it is to be employed and thus it is shown in partially fragmentary form in FIG. 2 with the understanding that the spindle normally will be of uniform cross section.

As in the FIG. 1 embodiment, spindle 61 has a roll support portion 63 and is shown as cylindrical in shape. As mentioned above, the shape of the support 63 may differ from that illustrated. Blades 69 and 71 are provided on the ends of the spindle 61, and a pair of hoods 65 and 67 are formed integrally therewith in a manner similar to the structure of FIG. 1.

Figure 3:
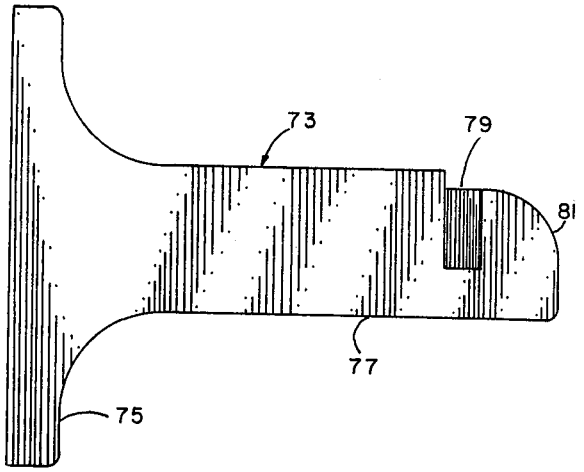
FIG. 3 is a side view of an arm member for the alternative embodiment of the invention of FIG. 2.
Figure 5:
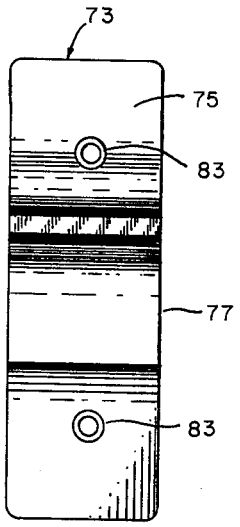
FIG. 5 is a front elevational view of the arm member of FIG. 3.

The alternative embodiment illustrated in FIGS. 2 through 5 has separate arm members, the right-hand one of which is illustrated in FIGS. 3 and 5 and designated 73. Thus the alternative embodiment is a three-piece structure rather than a two-piece structure as illustrated in FIG. 1. The left-hand arm corresponding to right-hand arm 73 is not illustrated as it would be an identical mirror image thereof.

Arm 73 has a bracket portion 75 in which there are 2 openings 83 for fasteners such as screws to secure the arm to the wall where the fixture is to be located. Other fastening means may be used as previously described. Arm 73 and the corresponding left-hand arm are to be located a distance apart such that the spindle 61 fits in slot 79 and the corresponding slot in the other arm with the blades 69 and 71 engaged by slot 79. The arm portion 77 of the alternative embodiment is substantially the same as the FIG. 1 embodiment and includes a curved surface on the front end designated 81. The curvature of the surface 81 matches the curvature of the hoods 65 and 67. Thus the spindle 61 is restrained both by the engagement of blades 69 and 71 in slots 79 and by the contact of hoods 65 and 67 with the curved surfaces 81. This restraint prevents accidental dislodgement of the spindle, at the same time readily permitting the intentional removal of the spindle for replacement of the roll.

While the alternative embodiment of FIGS. 2 through 5 is deemed most appropriate for longer paper rolls such as paper towels, it may also be advantageously used for toilet tissue rolls as well.

The material of which the holder may be made is subject to wide variation. Typically, the holder would be molded or cast from metal or plastic. However, it might be stamped from metal or machined or cut from wood, metal or other material. Further, the spindle portion may be made of a material different from the arms or bracket.

It may be noted that while the holder is described as attached to a vertical wall, it may also be attached to the underside of a cabinet or other surface oriented other than vertically.

In addition to the variations and modifications to the invention which have been described or suggested, other modifications will be apparent to those skilled in the art, and accordingly the scope of the invention is not to be deemed limited to those variations shown, described or suggested but is rather to be determined by the reference to the appended claims.

What is claimed is:

1. A holder for a paper roll comprising a pair of arms each having a length greater than the radius of a full paper roll and having a width about the same as its depth, said arms having means for mounting the same extending in parallel orientation from a wall surface, at least one of said arms having a slot near the end thereof extending into the arm from the top, and a spindle having at an end a blade conforming in shape at least in part to the interior configuration of said slot.

2. Apparatus as claimed in claim 1 further including a hood adjacent said blade shaped to cover at least part of the end of the corresponding arm.

3. Apparatus as claimed in claim 2 wherein said slot extends only part way through the width of said arm.

4. A holder for a paper roll comprising a pair of arms each having a length greater than the radius of a full paper roll and having a width not less than about one-eighth of its length, means for mounting said arms in parallel orientation on a wall surface, at least one of said arms having a slot near the end thereof extending into the arm from the top and a substantial portion of its width dimension from the surface which faces the other arm, and a spindle adapted to be supported by said arms and having at an end a blade conforming in shape at least in part to the interior configuration of said slot, and having a hood adjacent said blade shaped to cover at least part of the end of its corresponding arm.

5. Apparatus as claimed in claim 4 wherein said slot extends only part way through the width of said arm.

6. A holder for a paper roll comprising a pair of arms each having a length greater than the radius of a full paper roll and having a width not less than about one-eighth of its length, means for mounting said arms on a wall surface, at least one of said arms having a generally vertical slot near the end thereof extending into the arm at least a substantial portion of its depth dimension from the top and a substantial portion of its width dimension from the surface which faces the other arm and a spindle adapted to be supported by said arms and having a total length at least slightly greater than the spacing between the inside facing surfaces of said arms, said spindle having at an end a blade conforming in shape at least in part to the interior configuration of said slot, and having a hood adjacent said blade shaped to cover at least part of the end of its corresponding arm.

7. Apparatus as claimed in claim 6 wherein said slot extends only part way through the width of said arm.

8. Apparatus as claimed in claim 6 wherein said means for mounting includes a bracket interconnecting said arms and maintaining them parallel to each other.

9. Apparatus as claimed in claim 6 wherein a vertical cross section of each of said arms viewed from the end is rectangular.

10. A holder for a paper roll comprising a pair of arms each having a length greater than the radius of a full paper roll and having a width not less than about one-eight of its length, means for mounting said arms on a wall surface, at least one of said arms having a generally vertical slot near the end thereof extending into the arm at least a substantial portion of its depth dimension from the top and a substantial portion of its width dimension from the surface which faces the other arm and, a spindle adapted to be supported by said arms and having a total length at least slightly greater than the spacing between the inside facing surfaces of said arms, said spindle having at an end a blade conforming in shape at least in part to the interior configuration of said slot.

* * * * *